US005811935A

United States Patent [19]

Pinker et al.

[11] Patent Number: 5,811,935

[45] Date of Patent: Sep. 22, 1998

[54] DISCHARGE LAMP WITH T-SHAPED ELECTRODES

[75] Inventors: Ronald D. Pinker; Thomas F. McGee, III, both of Peerskill; David Alan Cammack, Scarborough; Babar Ali Khan, Ossining, all of N.Y.

[73] Assignee: Philips Electronics North America Corporation, New York, N.Y.

[21] Appl. No.: 753,546

[22] Filed: Nov. 26, 1996

[51] Int. Cl.[6] ..... H01J 17/04; H01J 61/06

[52] U.S. Cl. ..... 313/632; 313/574

[58] Field of Search ..... 313/631, 632, 313/574, 491, 484, 495, 584, 582; 445/50

[56] References Cited

U.S. PATENT DOCUMENTS

| | | | |
|---|---|---|---|
| 3,453,201 | 7/1969 | Mihara et al. | 313/631 |
| 4,389,277 | 6/1983 | de Vries | 445/49 |
| 4,990,826 | 2/1991 | Cocks et al. | 313/491 |
| 5,256,936 | 10/1993 | Itoh et al. | 313/495 |
| 5,285,131 | 2/1994 | Muller et al. | 313/578 |
| 5,438,343 | 8/1995 | Khan et al. | 313/493 |
| 5,574,327 | 11/1996 | Cammack et al. | 313/110 |

FOREIGN PATENT DOCUMENTS

| | | | |
|---|---|---|---|
| 0581376A1 | 2/1994 | European Pat. Off. | H01J 61/30 |
| WO9519027 | 7/1995 | WIPO . | |

OTHER PUBLICATIONS

"Performance and Design Consideration of the Thin–Film Tungsten Matrix Display", By Paul M. Alt et al, IEEE Transactions on Electrons Devices, vol. ED–20, No. 11, Nov. 1973, pp. 1006–1015.

"Chemical Vapor Deposition of Tungsten Silicides for VLSI/ULSI Applications", by John E.J. Schmitz, Noyes Publication, Chapter II, pp. 10–50 (no month).

*Primary Examiner*—Sandra L. O'Shea
*Assistant Examiner*—Michael Day

[57] ABSTRACT

A discharge lamp includes a first and a second substrate (12, 14), a cavity disposed in the first substrate (12) or in a portion of the first and a second substrate (12, 14), a first and a second aligned electrode (270, 272) disposed between the first and a second substrate (12, 14) having respective ends extending into the cavity, wherein the first and the second aligned electrode (270, 272) are "T-shaped" when viewed in cross-section. The T-shaped electrodes provide mechanical support that minimizes bending and distortion in the horizontal and vertical directions. The discharge lamp may include a charge of mercury or an inert gas, and may further include a phosphor layer (80).

4 Claims, 7 Drawing Sheets

DISCHARGE LAMP WITH T-SHAPED ELECTRODES

BACKGROUND AND SUMMARY OF THE INVENTION

The present invention is directed to high and low pressure gas discharge lamps used for lighting and display, and in particular, to an improved method of fabricating such lamps and an improved discharge lamp manufactured thereby.

Gas discharge lamps (mercury vapor, sodium vapor, metal halide) are an important segment of the lighting industry. It is well known that the luminous efficiency of gas discharge bulbs increases substantially at high pressures (1–200 atmospheres). However, the containment of such high pressures in a transparent vessel has presented significant problems. Gas pressure is restricted in many instances because of the difficulty of finding materials that are sufficiently lightweight, while at the same time capable of withstanding high heat and pressures. Furthermore, such materials, to be practicable, must be capable of relatively inexpensive mass production. The usual construction of gas discharge lamps is to suspend a transparent pressure and heat resistant discharge tube by means of a metal framework within an outer glass bulb.

The present invention provides an entirely new paradigm for the construction of high pressure gas discharge lamps. Rather than a discharge tube mechanically suspended within an outer bulb, the present invention is directed towards methods of fabricating high pressure "microlamps" utilizing micromachining techniques which are similar to integrated circuit fabrication techniques such as the etching of and bonding of planar substrates. The present invention is directed to an improved gas discharge lamp that can withstand very high pressures and the method of making such a lamp by means of integrated circuit manufacturing techniques. The lamp is manufactured from two planar sheets of temperature and pressure resistant transparent material. In one embodiment, the substrate material may be etched so as to receive the deposited electrode material in the etched portion of the substrate. A cavity is then etched in one or both of the substrates and the electrodes are thereafter deposited into the etched substrate to extend into the cavity region. Alternatively, the cavity may be etched prior to the deposition of the electrodes. The electrodes would be then manually inserted therein. The cavity is charged with a filler appropriate to the type of lamp being manufactured such as mercury, sodium or metal halides. The two sheets are then bonded together so as to seal the cavity within the sheets. Contact may then be made with the electrodes to activate the lamp. Electrodeless lamps activated by radio frequency energy may also be manufactured by this technique. Miniature gas discharge lasers may also be produced by this technique.

In a preferred embodiment the substrate is etched so as to form a trench that, when viewed in cross-section, has a "T-shape". Therefore, when the electrode material is thereafter deposited into the "T-shaped" trench and etched so as to be removed from the substrate surface where the electrode material is not desired, the formed electrodes, when viewed in cross-section, are also "T-shaped". Specifically, one of the sheets of transparent material (substrate) is etched so as to form a trench having two regions, each region being below the surface of the substrate, each region being defined as having a width and a depth, and wherein the width of one of the regions is greater than the width of the other region. This trench can be formed by suitable masking and etching techniques as disclosed herein. Thereafter, the suitable electrode material is deposited by suitable metal deposition processes, such as that described in the book "Chemical Vapor Deposition of Tungsten and Tungsten Silicides For VLSI/ULSI Applications", by John E. J. Schmitz, and pages 10–50, in particular. The electrode material, which in the preferred embodiment is tungsten, will conform to the "T-shaped" trench. Thereafter, a cavity in which the "T-shaped" electrode portions will extend, is formed and the lamp may be thereafter completed following the fabrication techniques disclosed above and throughout the specification.

Therefore, in accordance with the present invention, a method of fabricating a discharge lamp is provided. The method includes the steps of providing a substrate material, and in the substrate material, etching a trench having a first region having a width and a depth and a second region having a width and a depth. The substrate is etched so that the width of the second region is greater than the width of the first region. In a preferred embodiment, the depth to width ratio of the first region is preferably greater than 2:1 and the depth to width ratio of the second region is preferably greater than 1:2. After the electrode material is deposited on the substrate surface and in both the first and second trench regions, a cavity may be etched in the substrate so that the ends of each of the formed electrodes overhang and extend into the formed cavity. Thereafter, a second substrate may be contacted onto the first substrate and wafer bonding thereto.

Also provided is a discharge lamp fabricated from the above method. Accordingly, a discharge lamp constructed in accordance with the invention may include inter alia, first and second aligned electrodes, each electrode being disposed between the first and second substrates and including electrode portions that extend into a cavity formed in the substrates; and wherein each of the portions of the electrodes that extend into the cavity comprise a first region having a width and a depth and a second region having a width and a depth, the width of the second region being greater than the width of the first region so as to be "T-shaped" when viewed in cross-section. Moreover, the depth of the first region may be greater than the width of the first region.

BRIEF DESCRIPTION OF THE DRAWINGS

For better understanding of the invention, reference is made to the following drawings which are to be taken in conjunction with the detailed description to follow:

FIG. 6A is a sectional view of a partially etched trench in a substrate, and specifically, depicts the formation of the first trench region in accordance with the present invention;

FIG. 6B is a sectional view of a completely etched trench in a substrate in accordance with the present invention, and specifically, depicts the additional formation of the second trench region;

FIG. 6C is a sectional view of the etched trench in the substrate and a layer of electrode material having been deposited therein;

FIG. 6D is a sectional view of a "T-shaped" electrode having been etched from the electrode material depicted in FIG. 6C; and FIG. 6E is a sectional view of the "T-shaped" electrode of FIG. 6D and a cavity portion which has also been etched in the substrate;

DETAILED DESCRIPTION OF THE PREFERRED EMBODIMENT

Figure 1:
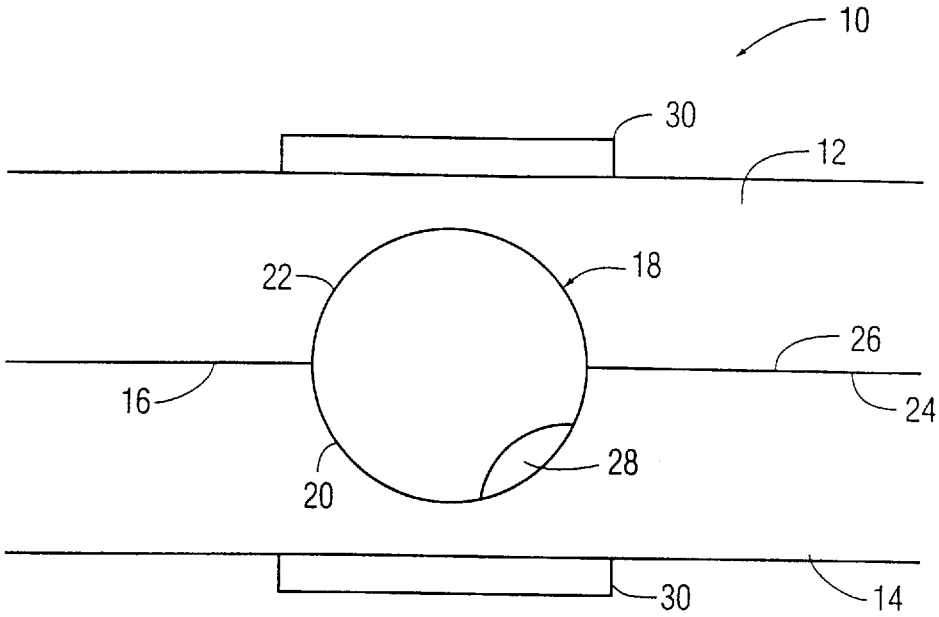
FIG. 1 is a sectional diagram of an electrodeless, radio frequency activated lamp constructed in accordance with the present invention.
Figure 2:
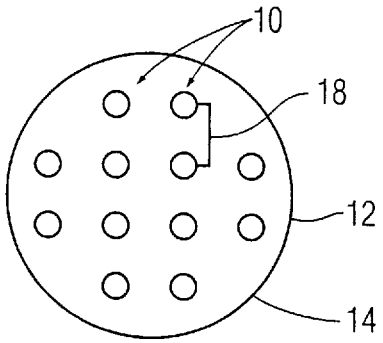
FIG. 2 is a plan view of the transparent substrates having a plurality of lamp cavities disposed therein.

FIGS. 1 and 2 illustrate a high pressure lamps fabricated in accordance with the present invention. As shown in FIGS. 1 and 2, a lamp 10 is fabricated from a first planar substrate 12 and a second planar substrate 14 which are bonded together by suitable means, as described below, and each lamp 10 comprises a plurality of cavities 18 which form individual luminescent micro-lamps. In FIGS. 1 and 2, the cavities 18 are depicted as generally spherical and the substrates 12 and 14 are depicted as circular in plan view. It should be kept in mind that the cavities and substrates may be of any size and shape. The substitutes are depicted as circular since handling equipment for circular plates is readily available from numbers of integrated circuit manufacturing equipment. Cavities 18 may be square, rectangular or elongated channels.

FIG. 1 illustrates a lamp constructed in accordance with the present invention in its simplest embodiment, that of an electrodeless RF activated lamp. The steps of manufacturing the lamp will also be discerned from this figure. Planar substrate 14 is transparent and consists of material suitable for containing the pressure and temperature of an operating lamp, one such suitable material is quartz. Cavity 18 which comprises a half cavity 20 in substrate 14 and a half cavity 22 in substrate 12 is formed by integrated circuit manufacturing techniques.

The upper surface 24 of un-etched substrate 14 is covered by suitable masking material, such as polysilicon, at the portions where etching is not desired, as etching will occur at the unmasked portions. Thereafter, the masked substrate is exposed to an etchant such as hydrofluoric acid for a time suitable to create cavity 20. The time and amount of exposure to the etchant may be adjusted, in the known manner, to provide the cavity size and shape desired. Upper substrate 12 is therefore masked and etched in a similar manner to provide half cavity 22. For certain bonding processes, it is desirable that the surfaces of substrates 12, 14 that are to be bonded together be planarized. This can be accomplished by depositing phosphorus doped silicon dioxide and polishing the surface. Alternatively a smooth surface can be obtained by depositing phosphorous doped silicon dioxide and reflowing (heating) it. Other methods of planarizing may also be used, such as spin-on-glass and chemical mechanical polishing.

After the formation of cavities 20 and 22 in substrates 12 and 14, respectively, cavity 20 is charged with a suitable luminescent material. In this embodiment, the lamp is a mercury lamp so that an appropriate sized drop of mercury 28 is placed in cavity 20. If cavity 18 is to be charged with a gas such as Argon, the bonding of substrates 12, 14 may take place in an argon atmosphere at a pressure suitable for the final lamp. Accordingly, substrates 12 and 14 are placed in a pressure vessel at the appropriate argon pressure for the lamp to be manufactured. Thereafter, lower surface 26 of substrate 12 is bonded to upper surface 24 of substrate 14. The bonding interface 16 may be formed by any suitable means such as heat, chemical or anodic bonding. After the bonding is completed, the completed lamp 10 is removed from the pressure vessel and cavity 18 will contain an argon atmosphere having a charge of mercury that will vaporize and form a mercury vapor lamp upon energization. Since this is an "electrodeless lamp", the mercury is vaporized and luminesces by application of RF energy with or without external RF electrodes 30. Without electrodes 30, for example, the lamp may be operated by placing it in a microwave cavity into which microwave energy is coupled.

It is to be recognized that, where the cavity 18 is to be charged with a gas such as Argon, charging may be accomplished by any suitable technique, without departing from the principles of the invention. For example, an alternative charging procedure is to (i) prepare the respective surfaces of the substrates 12, 14 for bonding, (ii) place these surfaces in proximity of one another so that van der Waals forces hold the substrates 12, 14 together, (iii) open a space between the substrates 12, 14 at a selected portion thereof, (iv) introduce the selected gas into the cavity 18 through the opened space and (v) close the space. The space is opened by overcoming the van der Waals forces, such as by application of a mechanical force at a selected point or edge of the substrates 12, 14. In so overcoming van der Waals forces, it is preferred to do so only partially so that the remaining forces hold the substrates together in the relative orientation and alignment achieved upon first placing the surfaces in proximity. Subsequent to closing the space, wafer bonding is completed to combine the substrates 12, 14 to form one body.

Figure 3:
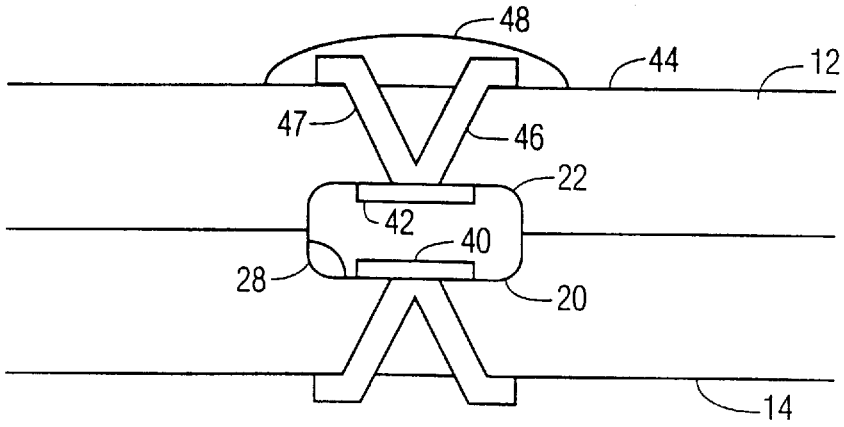
FIG. 3 is a sectional view of a lamp having opposed electrodes manufactured in accordance with the present invention.

FIG. 3 illustrates how the present invention is used to produce a lamp having electrodes which is a more common design than the RF lamp of FIG. 1. In FIG. 3, the same reference numerals are used to indicate the same structure that of FIG. 1. In FIG. 3, each half cavity 20, 22 in substrates 14, 12 is produced by masking and etching in a similar manner as the lamp of FIG. 1. After the etching of the half cavities 20, 22 a further manufacturing step takes place: the deposition of electrodes 40 and 42 in cavities 20, 22 respectively. The electrodes may be composed of any suitable electrode material, such as tungsten, and are deposited by known metal deposition processes, i.e. masking, etching and deposition of material. Since electrodes 40, 42 must be connected to current, electrical connection must be made to electrodes 40, 42. Connection with electrode 42 is made by etching a channel 46 in the upper surface 44 of substrate 12. In this case, upper surface 44 is masked at the areas to remain unetched and an etchant acts on the unmasked portions to etch channel 46 into surface 44 down to the electrode 42 to expose its rear surface. Thereafter, by deposition and patterning, a conductive layer 47 is applied in channel 46. The conductive layer 47 comprises conductive material that may be a metallic or non-metallic conductor, and extends from the electrode 40, 42 to the outer surface of the respective substrates. In order to maintain the pressure integrity of cavity 18, "plug" material 48 such as glass is deposited over the conductive layer 47 to strengthen cavity 18 and to render the outer substrate surfaces flush. Thereafter, substrates 12, 14 are charged with the appropriate luminescent material and bonded as is described above with respect to the lamp of FIG. 3. Connection of electrodes 40, 42 to an appropriate source of current will cause the lamp to illuminate. Additional pairs of electrodes, such as starter electrodes, may also be deposited and connected in a like manner.

Figure 4:
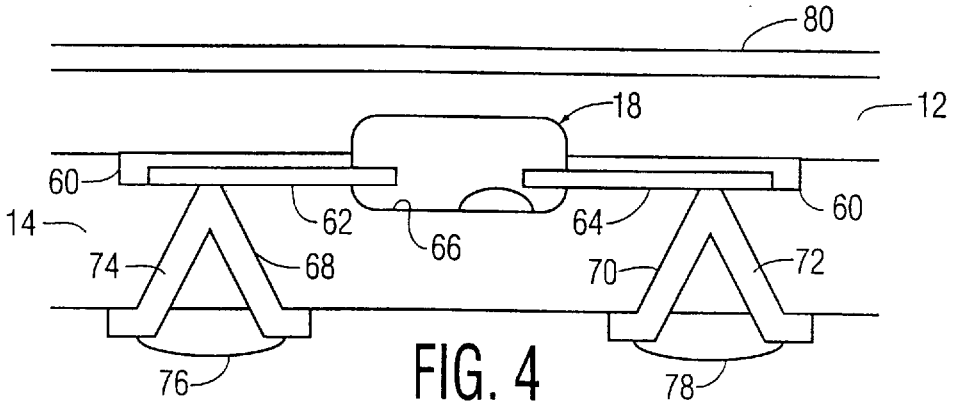
FIG. 4 is a sectional view of a side electrode lamp manufactured in accordance with the present invention.

FIG. 4 illustrates another embodiment of the present invention in which the electrodes are disposed in side-by-side relationship, the same reference numerals are again used to denote similar structure. As shown in FIG. 4, the upper substrate 12 is formed in a similar manner to the previous embodiments. However, lower substrate 14 is first masked and etched so as to form a relatively wide rectangular cavity 60 and electrodes 62, 64 are deposited on its flat lower surface. A second deeper central cavity 66 is then etched into substrate 14 by suitable masking and etching techniques, and by use of an etchant which does not attack the material of electrodes 62, 64. These electrodes will overhang cavity 66. Thereafter, the lower surface of substrate 14 is etched to create channels 68, 70 which contact the lower surface of electrodes 62, 64 respectively. A conductive layer 72, 74 may then be deposited in channel 70, 68 for electrical connection to electrode 64, 62. Thereafter, plug material 76, 78 may be used to fill in the gap between the lower surface of substrate 14 and conductive layers 72, 74. Then, the cavity 18 is charged and the substrate 12 bonded with substrate 14.

The present structure and methodology also lends itself to the manufacture of miniature fluorescent bulbs which utilize a phosphor coating which, when energized by the ultraviolet rays generated by mercury vapor, will fluoresce. In FIG. 4, the phosphor layer 80 is deposited on the upper surface of substrate 12. The lamp shown in FIG. 4 has both electrodes disposed in a single substrate and the electrical connections are made on a single substrate. It is also noted that in the construction of this type of lamp, there need not be a cavity 22 disposed in substrate 12 because if cavity 60 is large enough, upper substrate 12 may be merely a flat piece of quartz or glass.

Figure 5:
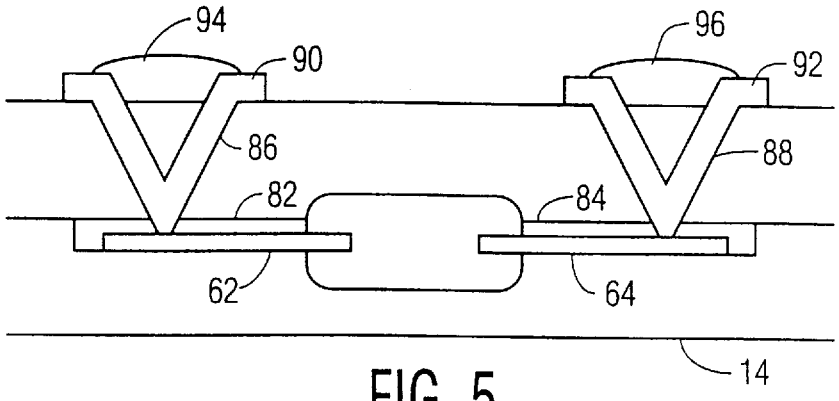
FIG. 5 is a sectional view of a further embodiment of a side electrode lamp constructed in accordance with the present invention.

FIG. 5 shows yet another variant of the side electrode lamp of FIG. 4. In the lamp shown in FIG. 5, the lower substrate 14 further includes deposition of layers 82, 84 of P-glass (phosphorus doped glass) which cover electrodes 62, 64 to a level equal to the upper surface of substrate 14. Thereafter, the upper substrate 12 has channels 86, 88 etched through substrate 12 and through the P-glass layers 82, 84 so as to expose the upper surface of electrodes 62, 64. Thereafter, conductive layers 90, 92 and plug material 94, 96 are deposited in channels 86 and 88. This arrangement permits contact with and connection to electrodes 62, 64 through the upper surface of the device rather than the lower surface of the device as shown in FIG. 4. The use of P-glass also provides an efficient sealing of the electrodes to the substrate.

Figure 6A:
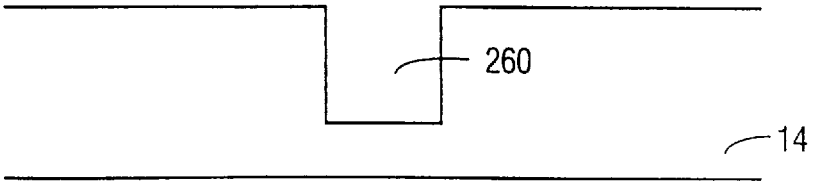
FIGS. 6A–6E are sectional views depicting the fabrication of a stably supported electrode having a "T-shaped" cross-section in accordance with an alternative embodiment of the present invention and in particular.
Figure 6B:
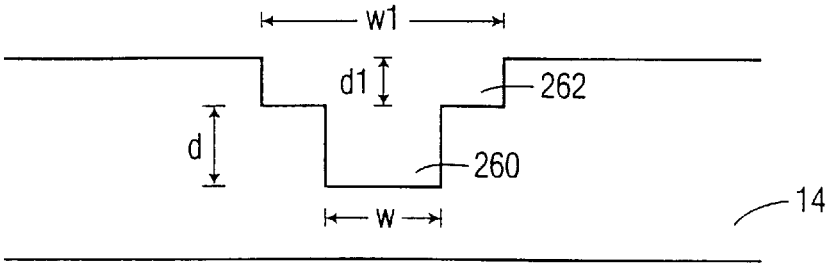
Figure 6C:
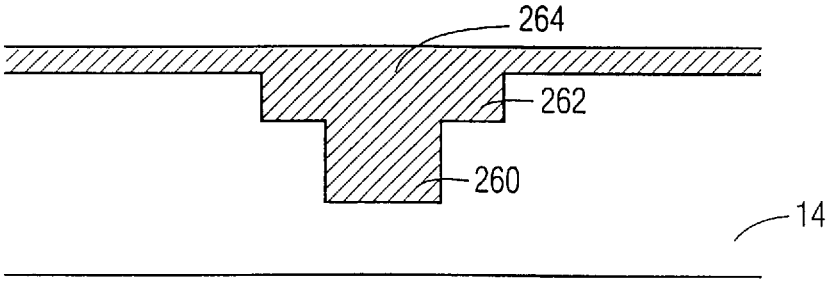
Figure 6D:
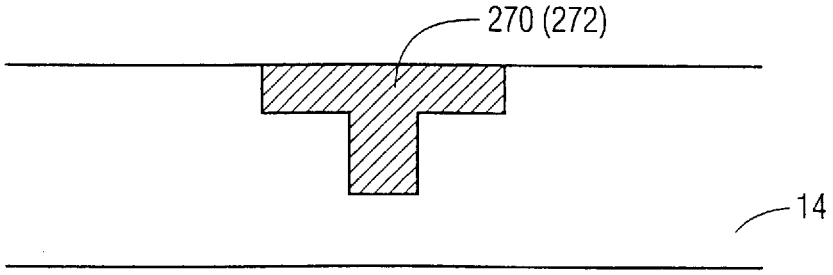
Figure 6E:
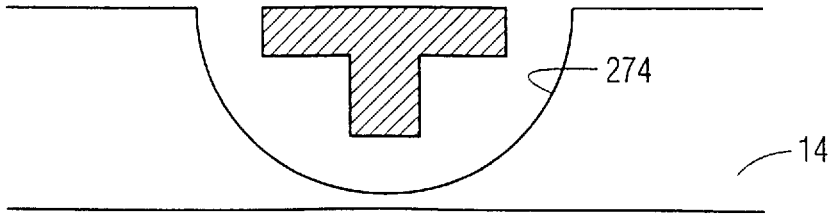
Figure 7:
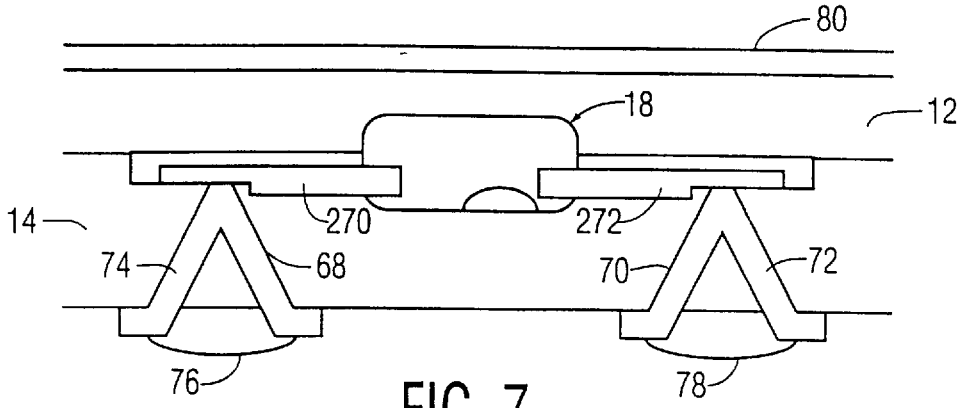
FIG. 7 is a sectional view of an electrode lamp including the "T-shaped" electrodes in accordance with the present invention.

Reference is now made to FIGS. 6A–E which depict the formation of, and the lamp structure including the "T-shaped" electrodes in accordance with the present invention, like numerals being used to depict like structure. As shown in FIG. 6A, lower substrate 14 is first masked and etched so as to form a first preferably rectangular trench region 260. Thereafter, as depicted in FIG. 6B, a second trench region 262 is etched into substrate 14. Trench region 260 has a width w and a depth d and trench region 262 has a width w1 and a depth d1. So as to form the below disclosed "T-shaped" electrodes, width w1 of trench region 262 is preferably greater than the width w of trench region 260. Additionally, it is preferred that the depth to width ratio of trench region 260 is preferably greater than 2:1 and the depth to width ratio of trench region 262 is preferably greater than 1:2. As depicted in FIG. 6C, after the etching of substrate 14 so as to form the trench region therein, suitable electrode material 264, such as tungsten, is deposited in trench regions 260, 262 by known metal deposition processes, such as that described in the book "Chemical Vapor Deposition of Tungsten and Tungsten Silicides For VLSI/ULSI Applications", by John E. J. Schmitz, and pages 10–50, in particular. As would be clear, the width of electrode material 264 deposited in region 262 is greater than the width of material 264 deposited in region 260. As depicted in FIG. 6D, the electrode material 264 is then etched so as to form electrodes 270, 272 (see FIG. 7) which, when viewed in cross-section, are "T-shaped". Thereafter, as illustrated in FIG. 6B a cavity 274 may be etched in a manner disclosed above. The formed electrodes 270, 272 may also be electrically connected to current as disclosed above. Thereafter, the remainder of the lamp structure is fabricated by the steps and processes also disclosed above.

Figure 8:
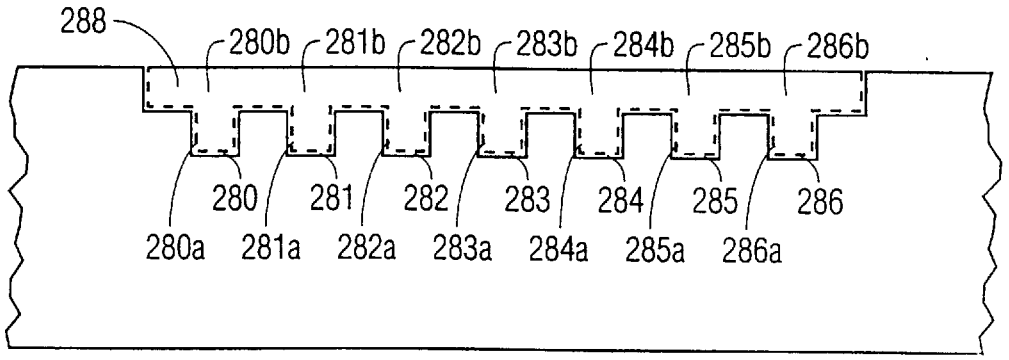
FIG. 8 is a sectional view of an alternative embodiment in which a plurality of trenches are formed in the substrate and an electrode material having been deposited completely (solid lines) and partially therein (dotted lines)
Figure 9:
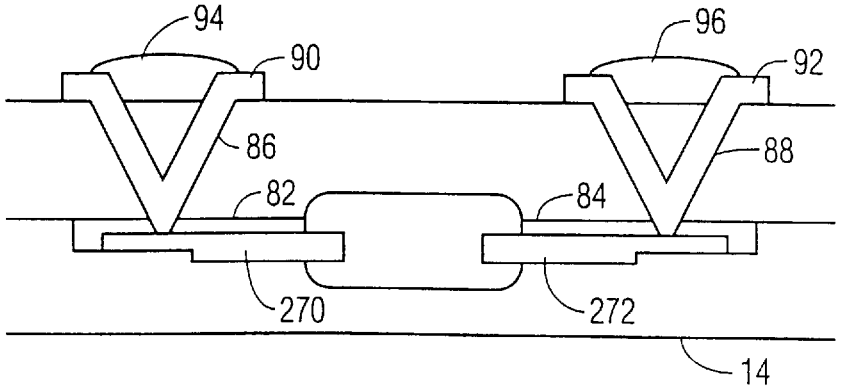
FIG. 9 is a sectional view of an alternative embodiment of the present invention depicting generally the electrode lamp construction depicted in FIG. 5 but with the "T-shaped" electrodes fabricated in accordance with the method depicted in FIGS. 6A–6E.

Reference is now made to FIG. 8 which depicts an alternative embodiment in accordance with the present invention wherein multiple trenches 280, 281, 282, 283, 284, 285 and 286 are parallelly formed by the aforementioned etching techniques. The number of trenches formed is governed, for example, by thermal considerations. That is, additional or fewer trenches can easily be fabricated while remaining within the scope of the invention. As depicted, each trench 280–286 has a respective corresponding first trench region 280*a*, 281*a*, 282*a*, 283*a*, 284*a*, 285*a* and 286*a* and a second trench region 280*b*, 281*b*, 282*b*, 283*b*, 284*b*, 285*b* and 286*b*.

Thereafter, trenches 280–286 may be completely filled by the depositing of electrode material 288 therein in the manner as set forth above. However, it is also contemplated that the trenches may not be completely filled, as depicted by the dotted lines in FIG. 8. By not completely filling trenches 280–286, a corrugated structure may be formed. Such a corrugated structure, in addition to the increased rigidity as discussed below, has an increased surface area compared to the "T-shaped" electrodes formed by completely filling the second trench regions. This increase in surface area increases the radiative losses at the electrode which will result in advantageously lower electrode temperatures.

Experimentation and analysis has determined that high levels of stress exist in and on the electrodes having a non "T-shaped" cross-section. The internal and external stresses from deposition acting upon the electrodes causes bowing and/or bending of the electrode ends that overhang and extend into the aforementioned etched cavity regions. At least part of the stress on the electrodes is due to the electrode tips being unsupported as they extend into the cavity portion. The internal stresses in the electrodes during operation may cause the unsupported electrode tips to bend and/or curl.

Accordingly, it is clear that such stresses may cause the tips of the electrodes that extend into the cavity to deflect, either vertically and/or horizontally depending upon the direction in which the stress is acting upon the electrode portions. Accordingly, prior to the present invention, it has been difficult to deposit a thick layer (greater than 10 micrometers) with low stress because the stress levels increase with increased electrode thickness.

The present invention by which "T-shaped" electrodes are formed and in which lamp structures include these "T-shaped" electrodes significantly reduce the problem associated with bending and/or bowing of the electrodes tips. Specifically the rotational inertia of the electrodes is significantly increased because of the "T-shaped" configuration. Accordingly, less bending and/or bowing of the electrodes takes place during fabrication thereof or during operation of the lamp structure manufactured thereby. Additionally, with respect to trench region 260, the desired width attainable is twice the layer thickness deposited.

Additionally, an advantage provided by the invention disclosed herein is that the desired trench configuration can be patterned within a shallow etched region, so that the electrodes are below the wafer surface. In this way, the electrode material can be continuous over the trenches and onto the test region and proper electrode contact and wafer bonding can be achieved thereby.

Figure 10:
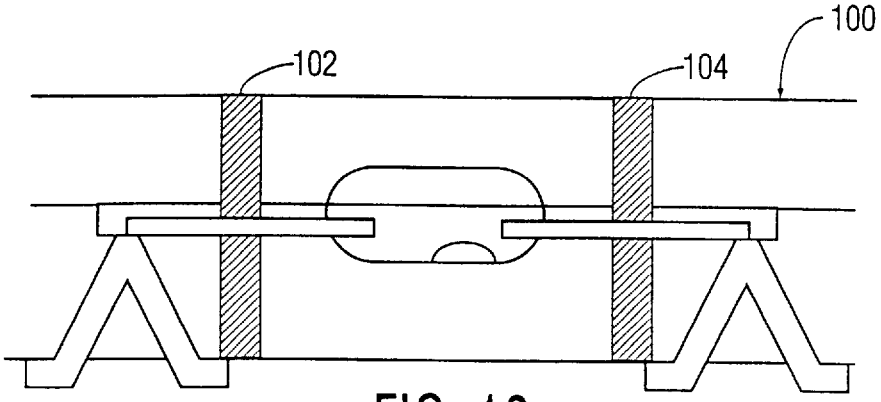
FIG. 10 is a sectional view of a side electrode lamp including melt zones to further seal the electrodes.

FIG. 10 illustrates a side electrode lamp 100 which is constructed similar to that of FIG. 4 with the addition of melt zones 102, 104 which are used to further seal the electrodes within the substrates. Melt zones 102, 104 are formed by exposing the completed lamp to a $CO_2$ laser which will melt the quartz substrates to seal the tungsten electrodes firmly therewithin. Additionally, a layer of molybdenum may be added to the tungsten electrodes to aid in sealing. The molybdenum layer will assist the substrate/electrode seal with or without melt zones 102, 104. Additionally, the "T-shaped trenches and electrodes can be formed and constructed consistent with this alternative embodiment.

Figure 13A:
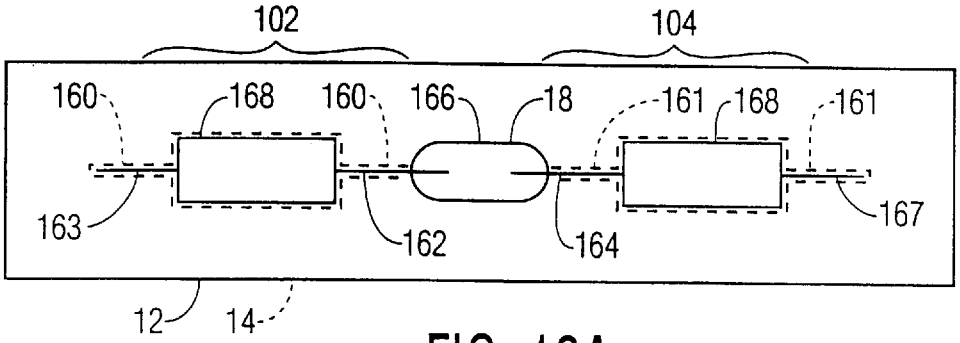
FIGS. 13A, 13B and 13C are top and sectional views of a further embodiment of a lamp constructed in accordance with the present invention.
Figure 13B:
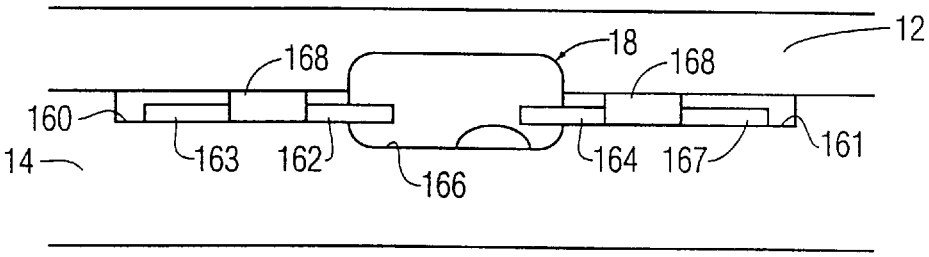
Figure 13C:
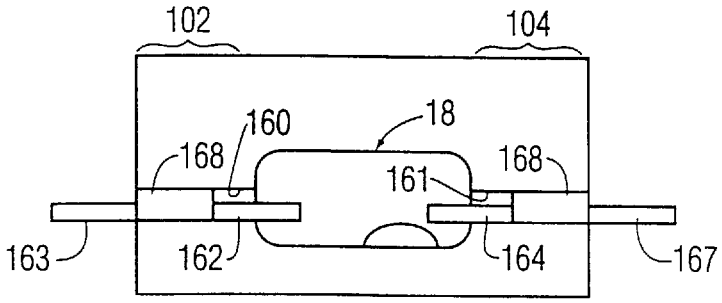

FIGS. 13A–C illustrate another embodiment of the present invention in which the electrodes are disposed in side-by-side relationship, and the same reference numerals are again used to denote similar structure. As shown in these Figures, at least one of the substrates 12, 14 is masked and etched so as to form a lamp cavity 18, including a central cavity 166, and to form opposed electrode cavities 160, 161. The cavities 18, 160, 161, 166 may be formed as described above with respect to fabricating the lamp of FIG. 4, except for the omission of deposition of electrodes.

Rather than forming electrodes by deposition, preformed electrodes 162, 164 are used which are disposed in the respective electrode cavities 160, 161. Preferably, the disposition provides for the preformed electrodes 162, 164 to overhang the central cavity 166. The preformed electrodes preferably are rods, wires, foils, or ribbons, or combinations thereof, and comprise any suitable material, such as tungsten, titanium, alloys or otherwise.

The preformed electrodes preferably have an associated sealing element 168. For example, the sealing element 168 shown is a molybdenum layer, pad or foil which is welded or otherwise joined. The sealing element 168 provides for formation of a seal between the electrodes and the substrates so as to maintain the charge of luminescent material.

Preferably, the preformed electrodes 162, 164 and the respective cavities 160, 161 have corresponding shapes and dimensions. It is to be recognized, however, that the electrode cavities 160, 161 can be of any shape and dimension suitable to receive the respective electrode 162, 164. For example, the electrode cavity 160 shown in FIG. 13A could have a substantially constant width along its length equal to the width at the sealing element 168. Similarly, the cavities and the correspondingly preformed electrodes may be "T-shaped" as discussed above so as to achieve the advantages disclosed herein.

FIGS. 13 also illustrate use of melt zones 102, 104, also to seal the electrodes 162, 164 relative to the substrates 12, 14. The melt zones 102 and 104 preferably cover the sealing elements 168 and, as well, extend to the edge of the respective side of the lamp cavity 18. It is to be recognized that each of these and other sealing expedients can be used with or without any one or more of these or other sealing expedients.

The preformed electrodes 162, 164 provide for electrical connection. Such connection can be accomplished similarly to that described previously, i.e., by etching either or both substrates 12, 14 to create channels which contact the electrodes and then depositing conductive layers in the so-formed channels so as to make electrical connection between the electrodes 162, 164 and some contact at one or more surfaces of the substrates. In the alternative, FIG. 13C shows the electrical connection provided by trimming the substrates 12, 14 so as to expose the ends 163, 167 of each electrode 162, 164 away from the cavity 166. Trimming preferably is performed, after the wafer bonding step is completed, by laser-cutting or any other suitable method.

The cavity 166 is charged using the methods previously described or any other suitable method. The substrates 12, 14 are wafer bonded as previously described. It is to be recognized, however, that electrode cavities 160, 161 may be etched into one or both substrates 12, 14, without departing from the principles of the invention. In the case where only a first substrate is so etched, it is preferred that the first substrate is also etched to form all or part of the lamp cavity 18. However, the lamp cavity 18 may be formed without etching the first substrate, but rather only etching the second substrate, i.e., in forming the central cavity 166.

Figure 14A:
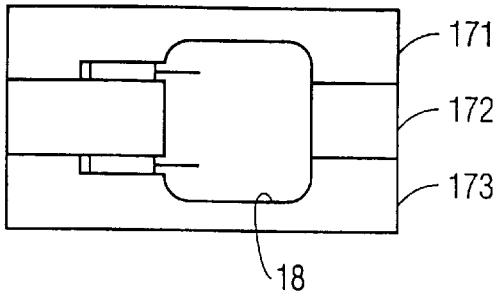
FIGS. 14A, 14B, 14C and 14D are sectional views of a further embodiment of a lamp constructed in accordance with the present invention.
Figure 14B:
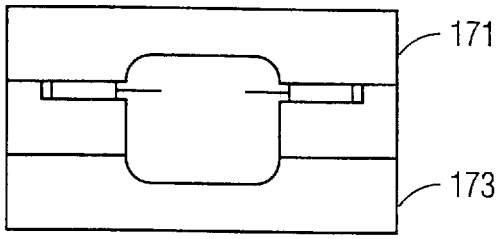
Figure 14C:
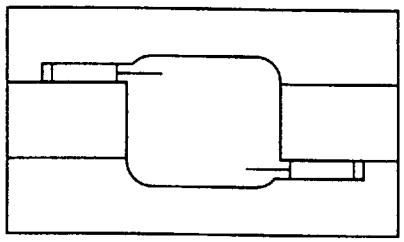

FIGS. 14A–D illustrate several additional embodiments of the present invention in which greater than two substrates are used to form the lamp. In FIG. 14A, the electrodes are disposed in top-bottom relationship in top and bottom substrates 171, 173. The electrodes are disposed on one side of the lamp cavity 18 and separated by central substrate 172. In FIGS. 14B and C, the electrodes are disposed in a side-by-side relationship, i.e., one on each side of the lamp cavity 18. More specifically, in FIG. 14B the electrodes are disposed opposite one another in the central substrate 172, while in FIG. 14C the electrodes are disposed staggered relative to one another in the top and bottom substrates 171, 173.

Figure 14D:
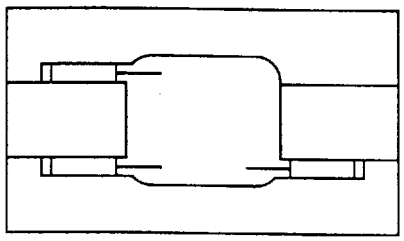

It is to be recognized that other electrode numbers and/or dispositions can be used without departing from the principles of the invention. For example, more than two electrodes can be used in a lamp fabricated according to the invention. As shown in FIG. 14D, three electrodes are used. In such case, the additional electrodes can be used to ignite the lamp at reduced voltages. In addition, an ignition circuit for such lamp could be separated from the lamp ballast circuitry since different electrode combinations can be used for ignition and steady state operation. Reduction in complexity and cost of a ballast for such lamp may then be realized. Similarly, the cavities and the correspondingly formed electrodes may be "T-shaped" as discussed above so as to achieve the advantages disclosed herein.

It is also to be recognized that, while FIGS. 14 show use of three substrates, more than three substrates can be used without departing from the principles of the invention. For example, additional substrates can be used to increase the volume of the lamp cavity 18, or to increase the overall thickness of the exterior walls of the lamp, or both, or otherwise.

In addition, it is to be recognized that, while FIGS. 14 show both electrodes disposed on a commonly-oriented surfaces of their respective substrates, such common disposition is not required. That is, one electrode can be disposed on the upper surface of its substrate while a second electrode can be disposed on the lower surface of its substrate.

As noted above, lamps fabricated by this methodology may be any type of gas discharge lamp. The material suitable for the substrates is also not required to be quartz as any transparent material capable of withstanding the heat and pressure that may be used. In certain circumstances, glass is a suitable substrate for use with the certain types of lamps. The number of cavities disposed in the substrate may be varied in accordance with the requirements of the application. The lamps may be used as illumination or as display. Finally, the lamps can be energized all at once or circuitry can be disposed on the substrate so as to provide non-simultaneous activation of the various microlamps disclosed in the substrate.

Figure 11:
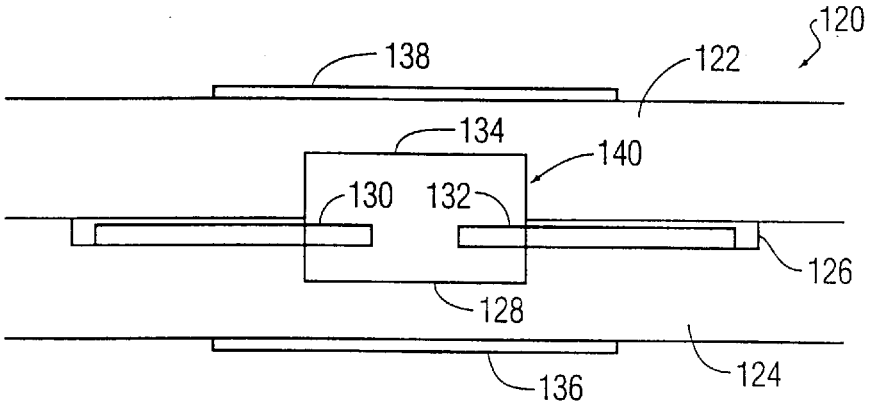
FIGS. 11 and 12 are sectional views of micro-lasers constructed in accordance with the invention.

FIG. 11 illustrates a micro-laser constructed in accordance with the invention. Micro-laser 120 is constructed, as are the previous gas discharge lamps, from an upper substrate 122 and a lower substrate 124. Lower substrate 124 has a first, relatively shallow channel 126 disposed thereon and a second deeper channel 128 at its centermost portion. By etching and deposition techniques similar or identical to those described above extending into channel 128 are first and second electrodes 130, 132. Similarly upper substrate 122 has a channel 134 formed therein. Mounted to the exterior of substrate 124 is a partially reflective mirror 136 formed by metal deposition, photolithographic techniques and etching. Disposed on the upper substrate 122 is a fully reflective mirror 138. A central cavity 140 is formed by the half cavities 128, 134 and may be charged with gaseous material which will lase under application of electrical input applied on electrodes 132, 130. Likewise, the cavities and the correspondingly formed electrodes may be "T-shaped" as discussed above so as to achieve the advantages disclosed herein.

When a discharge is created within cavity 140 the action of mirrors 136 and 138 will provide a lasing action such as to cause the atoms of the gaseous material to lase as is known to those skilled in the art of gas discharge lasers. Thus, partially reflective mirror 136 and fully reflective mirror 138 form an optical cavity for the excitation of atoms of the gaseous fill material. Suitable gaseous fill material are those usually utilized in large size gas discharge lasers.

Such material includes $CO_2$, Helium-Neon, Argon and the like. By suitable selection of the gaseous material and by the size and properties of the optical cavity, the lasing frequency may be adjusted over a wide frequency range. Such frequencies can range from the infrared to the ultraviolet. Gas discharge lasers are capable of generating light of a blue frequency or higher which, at this date, are difficult for solid state devices. Micro-lasers constructed in accordance with this invention can also be "electrodeless". Such lasers can be pumped through the application of external RF or microwave energy.

Figure 12:
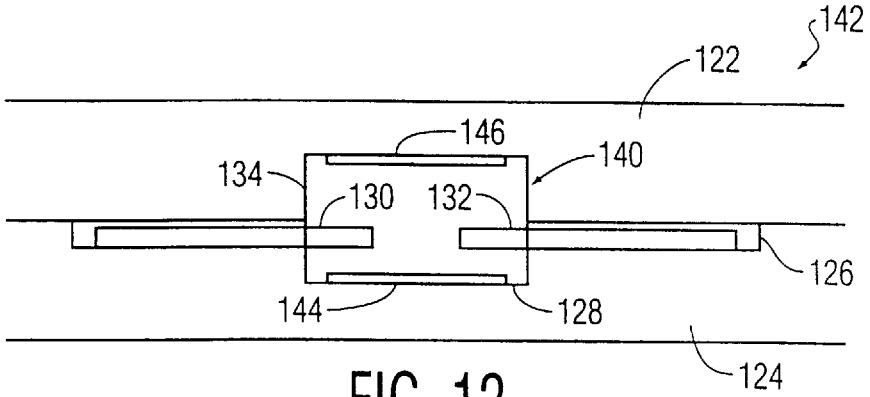

FIG. 12 shows another embodiment of a micro-laser constructed in accordance with the present invention. In FIG. 12 the same reference numerals are used to indicate the same structure as that of FIG. 11. In the laser structure of FIG. 11, mirrors 136 and 138 were disposed external to the substrates. The present invention does not require that the mirrors be disposed externally of the optical cavity. FIG. 12 illustrates a laser structure including mirrors disposed in cavity 140. In FIG. 12 a partially reflective mirror 144 is disposed on the lower surface of cavity 128 in lower substrate 124. A fully reflective mirror 146 is disposed on the upper surface of cavity 134 in upper substrate 122. The mirrors used in the structures of FIG. 11 and FIG. 12 may also be constructed from metallic materials which may be deposited within the substrates. It is to be further noted that the mirrors utilized in construction with the micro-lasers of FIG. 11 and FIG. 12 need not have planar surfaces. The mirror surfaces could be curved in accordance with any special requirements. Furthermore the mirrors can be spaced apart from the substrates and need not be mounted thereto. A particularly suitable substrate material for use in a laser device is sapphire. Since sapphire is crystalline anisotropic etching can provide mirrors with superior optical qualities. Likewise, the cavities and the correspondingly formed electrodes may be "T-shaped" as discussed above so as to achieve the advantages disclosed herein.

The above described structures and methodology are merely illustrative of the principles of the present invention. Numerous modifications and adaptations thereof will be readily apparent to those skilled in the art without departing from the spirit and scope of the present invention and the appended claims.

What is claimed is:

1. A discharge lamp, said discharge lamp comprising:

a first and second substrate;

a cavity disposed in said first substrate or in a portion of both said first and second substrates;

first and second aligned electrodes being disposed between said first and second substrates, each of said aligned electrodes having respective first ends extending into said cavity; and wherein each of said first and second aligned electrodes comprise:

a first portion having width and a depth and a second portion having a width and a depth, said width of said second portion being greater than said width of said first portion; and said first and second substrates being wafer bonded together.

2. The discharge lamp as claimed in claim 1, wherein at least a portion of each of said first and second electrodes form a "T-shape" when viewed in cross-section, said cross-sectional view being orthongal to the plane of said substrates.

3. The discharge lamp as claimed in claim 1, wherein said first and second electrodes are preformed electrodes.

4. The discharge lamp as claimed in claim 3, wherein said preformed electrode is disposed so as to overhang into said lamp cavity.

* * * * *

UNITED STATES PATENT AND TRADEMARK OFFICE

CERTIFICATE OF CORRECTION

PATENT NO. : 5,811,935

DATED : September 22, 1998

INVENTOR(S) : Ronald D. Pinker, Thomas F. McGee,III
David Alan Cammack, Babar A. Khan It is certified that error appears in the above-identified patent and that said Letters Patent is hereby corrected as shown below:

Column1, line3, after the title and before the Background and Summary of the Invention, insert the following paragraph:

--This invention was made with the United States Government support under Cooperative Agreement No. 10NANB441510 awarded by the National Institute for Standards and Technology (NIST). The United States Government has certain rights in the invention.--

Signed and Sealed this

Twenty-fifth Day of May, 1999

*Attest:*

Q. TODD DICKINSON

*Attesting Officer*

*Acting Commissioner of Patents and Trademarks*